US007713468B2

(12) United States Patent
Persson et al.

(10) Patent No.: US 7,713,468 B2
(45) Date of Patent: May 11, 2010

(54) METHOD OF MAKING A SINTERED BODY, A POWDER MIXTURE AND A SINTERED BODY

(75) Inventors: Jeanette Persson, Nacka (SE); Leif Dahl, Hägersten (SE); Gerold Weinl, Älvsjö (SE); Ulf Rolander, Stockholm (SE)

(73) Assignee: Sandvik Intellectual Property AB, Sandviken (SE)

( * ) Notice: Subject to any disclaimer, the term of this patent is extended or adjusted under 35 U.S.C. 154(b) by 34 days.

(21) Appl. No.: 11/984,486

(22) Filed: Nov. 19, 2007

(65) Prior Publication Data

US 2008/0127776 A1 Jun. 5, 2008

(30) Foreign Application Priority Data

Nov. 22, 2006 (SE) ..... 0602494

(51) Int. Cl.
*B22F 3/12* (2006.01)
*C22C 29/06* (2006.01)

(52) U.S. Cl. ..... 419/32; 419/38; 75/240; 75/242; 75/252

(58) Field of Classification Search ..... 75/240, 75/242, 252; 419/32, 38
See application file for complete search history.

(56) References Cited

U.S. PATENT DOCUMENTS

| | | | | |
|---|---|---|---|---|
| 3,672,867 | A | 6/1972 | Little | |
| 4,545,814 | A * | 10/1985 | Chou et al. | 75/365 |
| 5,889,219 | A * | 3/1999 | Moriguchi et al. | 75/236 |
| 6,024,776 | A | 2/2000 | Heinrich et al. | |

FOREIGN PATENT DOCUMENTS

| | | |
|---|---|---|
| EP | 0 578 720 | 8/2000 |
| EP | 1 033 414 | 9/2000 |
| JP | 2005-336565 | 12/2005 |
| WO | 98/03691 | 1/1998 |

OTHER PUBLICATIONS

J. Y. Huang et al., "Phase transformation of cobalt induced by ball milling", *App. Phys. Lett*. 66 (3) Jan. 16, 1995, pp. 308-310.

E. A, Owen et al., "Effect of Grain Size on the Crystal Structure of Cobalt", *Proceedings of the Physical Society, Section B*, vol. 67, Issue 6 (1954), pp. 456-466.

Congxun et al., "Effect of Rare Earth on Properties and Microstructure of Tungsten-Cobalt-Titanium Hard Alloy", Journal of Rare Earths, vol. 12, No. 3, pp. 234-238, Sep. 1994 (w/English-translation).

Brookes et al., "*Hartmetals Still at the Cutting Edge", Metal Powder Report*, , Sep. 1999, vol. 54, No. 9, pp. 21-23 (XP002554372).

* cited by examiner

*Primary Examiner*—Roy King
*Assistant Examiner*—Ngoclan T Mai
(74) *Attorney, Agent, or Firm*—Drinker Biddle & Reath LLP

(57) ABSTRACT

Method of producing a sintered body comprising the steps of mixing one or more powders forming hard constituents with powders forming a binder phase comprising cobalt powder where the cobalt powder comprises cobalt having mainly a fcc-structure defined as the peak height ratio between the Co-fcc(200)/Co-hcp(101) being greater than or equal to about 3/2, as measured between the baseline and maximum peak height, measured by XRD with a 2θ/θ focusing geometry and Cu-Kα radiation. The present invention also relates to a ready-to-press powder comprising cobalt having mainly a fcc-structure and where the cobalt powder has a grain size (FSSS) of from about 0.2 to about 2.9 μm. The present invention also relates to sintered bodies made according to the method. The sintered bodied according to the present invention have reduced porosity and less crack formation.

24 Claims, 2 Drawing Sheets

METHOD OF MAKING A SINTERED BODY, A POWDER MIXTURE AND A SINTERED BODY

BACKGROUND OF THE INVENTION

The present invention relates to a method of producing a sintered body comprising mixing one or more powders forming hard constituents and powder forming binder phase comprising cobalt, wherein the cobalt powder mainly has a face centered cubic (fcc) structure. The present invention also relates to a granulated "ready-to-press" powder comprising one or more hard constituents, organic binders and powders forming binder phase comprising cobalt, wherein the cobalt powder mainly has a face centered cubic (fcc) structure. The present invention also relates to a sintered body made according to the method of the invention.

Sintered bodies like round tools, cutting tool inserts etc. are usually made from materials containing cemented carbides or titanium based carbonitride alloys, often referred to as cermets. These materials contain one or more hard constituents such as carbides or carbonitrides of e.g. tungsten, titanium, tantalum, niobium, chromium etc together with a binder phase. Depending on composition and grain size, a wide range of materials combining hardness and toughness can be used in many applications, for instance in rock drilling and metal cutting tools, in wear parts etc. The sintered bodies are made by techniques common in powder metallurgy like milling, granulation, compaction and sintering.

The use of cobalt as a binder phase when manufacturing cemented carbides and cermets is well known in the art.

Cobalt is allotropic, that is, at temperatures less than about 417° C., pure cobalt atoms are arranged in a hexagonal close packed (hcp) structure and at temperatures more than about 417° C., pure cobalt atoms are arranged in a face centered cubic (fcc) structure. Thus, above 417° C., pure cobalt exhibits an allotropic transformation, i.e. the hcp-structure changes to fcc-structure.

The cobalt powder conventionally used when manufacturing sintered bodies such as drills, cutting tool inserts etc. usually has an hcp-structure. However, in a sintered body the cobalt binder phase has an fcc-structure which is obtained during the sintering operation.

During manufacturing of sintered bodies it is important that the cobalt powder is easily dispersed during milling or mixing. This is especially important when making sintered bodies of fine grain materials, materials with low amounts of binder or by using raw materials whose properties may be destroyed by intense milling. Fine grained raw materials usually require higher compaction pressures which normally are not desired due to the risk of pressing cracks in the pressed bodies, abnormal wear and even risk of compaction tool failure. Due to this, a decrease in compaction pressure is desired.

Several attempts have been made to improve the quality of the cobalt powder to make it more dispersible. Cobalt with smaller grains, down to 0.5 μm, has been produced industrially and also, a transition from an elongated to a spherical morphology has been done. Different techniques have also been developed to coat the hard constituents to obtain a composite powder with well distributed cobalt without milling.

EP 0578720 A discloses a method of making cemented carbide articles using binder phase powders with spherical, non-agglomerated particles. The use of such binder powders, preferably cobalt powders, gives sintered bodies with reduced porosity.

WO 98/03691 discloses a method of making cemented carbide with a narrow grain size distribution. To obtain a material with narrow grain size distribution the tungsten carbide is coated with cobalt prior mixing with other constituents. Further, the mixing method is chosen so that no change in grain size or grain size distribution occurs.

However, further improvements regarding cracks, porosity, dispersibility of the cobalt etc. are still required. The present invention disclosed herein further improves properties like dispersibility, pressing cracks and porosity.

OBJECTS AND SUMMARY OF THE INVENTION

It is an object of the present invention to provide a method of making sintered bodies from a powder with well distributed cobalt and with optimum compaction pressure.

It is a further object of the present invention to provide a method of making a sintered body with reduced porosity.

It is yet a further object of the present invention to provide a method of making a sintered body with a reduced amount of cracks.

It is a further object of the invention to provide a powder mixture with well distributed cobalt without extensive milling.

It is yet a further object of the present invention to provide a sintered body made according to the method of the invention.

In one aspect of the present invention, there is provided a method of producing a sintered body comprising the steps of mixing one or more powders forming hard constituents with powders forming a binder phase comprising cobalt powder by milling, granulation of the milled mixture, compaction of the granulated mixture to form a compacted body, sintering the compacted body, wherein the cobalt powder comprises cobalt having mainly an fcc-structure defined as the peak height ratio between the Co-fcc(200)/Co-hcp(101) being greater than or equal to about 3/2, as measured between the baseline and maximum peak height, measured by XRD with a $2\theta/\theta$ focusing geometry and Cu-K$\alpha$ radiation and where the cobalt powder has a grain size (FSSS) of from about 0.2 to about 2.9 μm.

In another aspect of the present invention there is provided a powder mixture ready to use in a compaction operation to form a compact which is subsequently sintered, comprising hard constituents and cobalt, the powder mixture comprising cobalt powder comprising cobalt having mainly an fcc-structure defined as the peak height ratio between the Co-fcc(200)/Co-hcp (101) being greater than or equal to about 3/2 as measured between the baseline and maximum peak height, measured by XRD with a $2\theta/\theta$ focusing geometry and Cu-K$\alpha$ radiation and where the cobalt powder has a grain size (FSSS) of from about 0.2 to about 2.9 μm.

DETAILED DESCRIPTION OF THE PREFERRED EMBODIMENTS

Figure 1A:
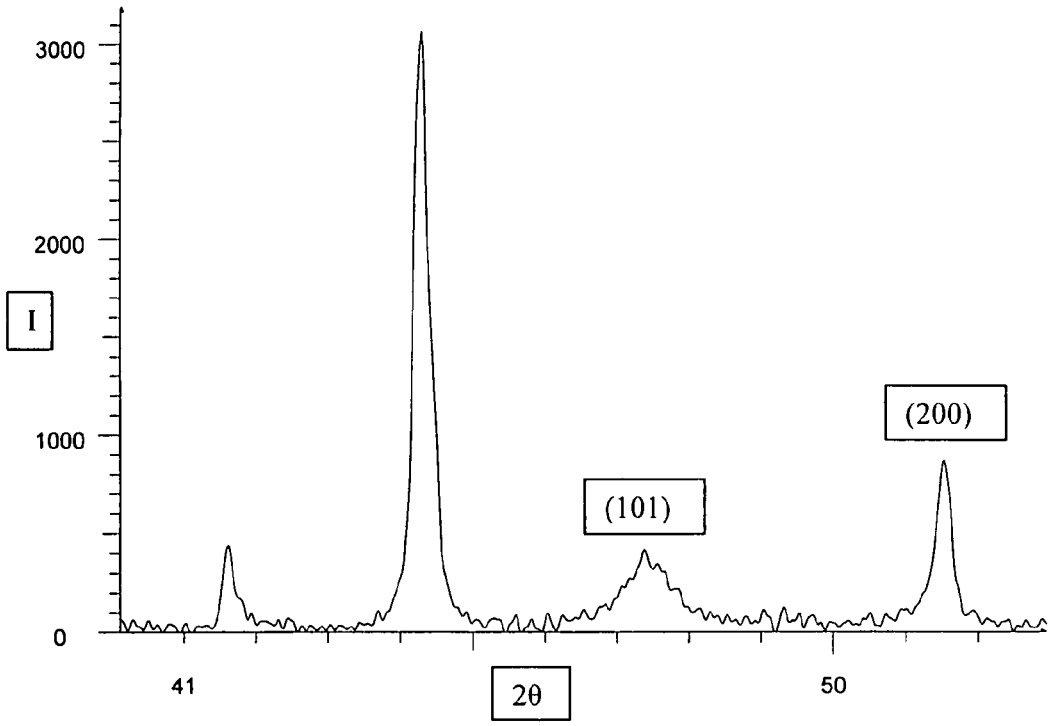
FIG. 1*a* shows the XRD pattern from an ultrafine cobalt powder according to the present invention characterized by a Co-fcc(200)/Co-hcp(101) ratio of 2.12. The powder has a Fischer grain size (FSSS) of 1.08 μm.
Figure 1B:
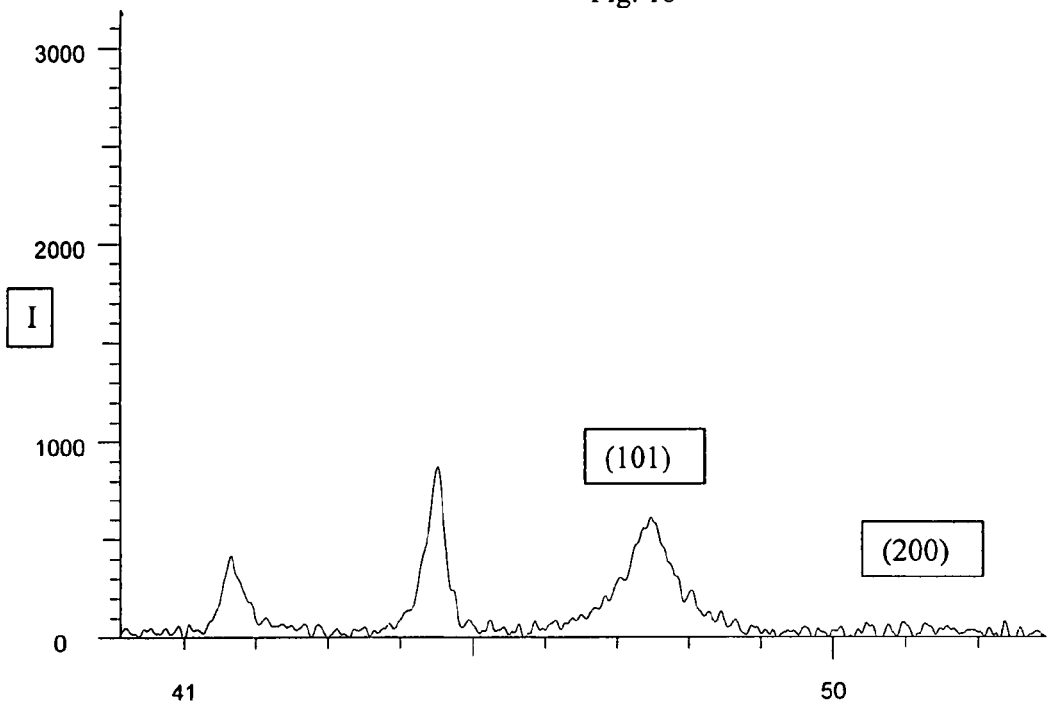
FIG. 1*b* shows the XRD pattern from a commercial ultrafine cobalt powder with a Co-fcc(200)/Co-hcp(101) ratio of 0.08 and an FSSS of 0.7 μm.
Figure 2A:
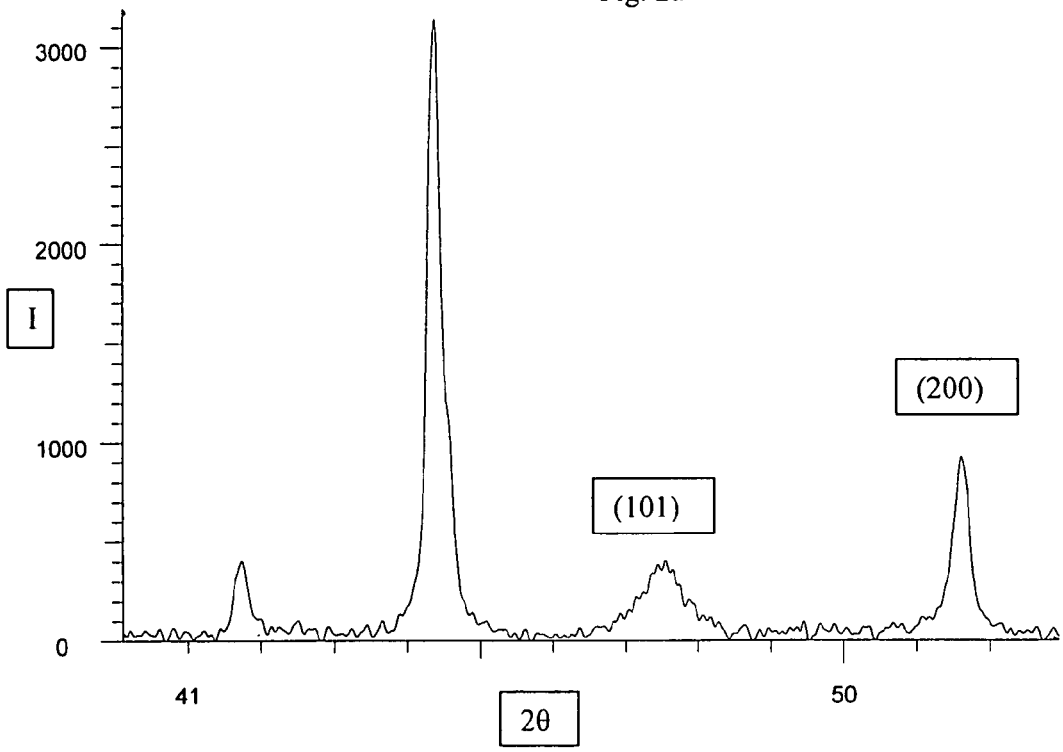
FIG. 2*a* shows the XRD pattern from a extrafine cobalt powder according to the present invention characterized by a Co-fcc(200)/Co-hcp(101) ratio of 2.24. The powder has a Fischer grain size (FSSS) of 1.45 μm.
Figure 2B:
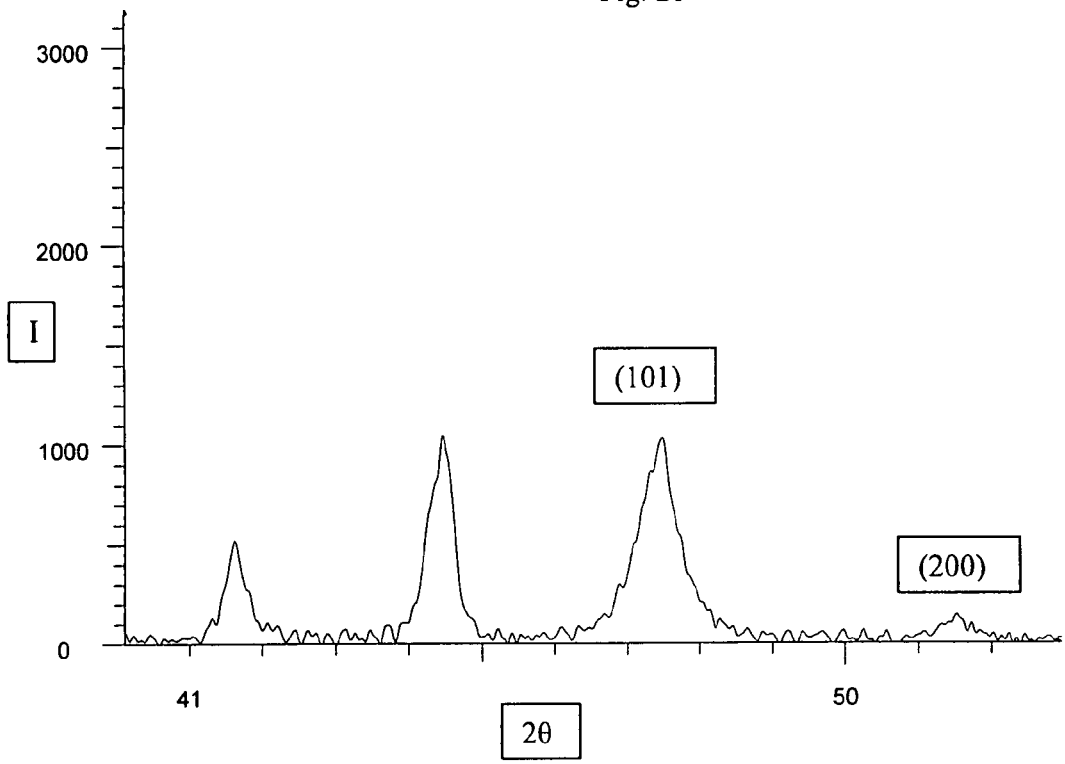
FIG. 2*b* shows the XRD pattern from a commercial extrafine cobalt powder with a Co-fcc(200) /Co-hcp(101) ratio of 0.14 and an FSSS of 1.4 μm.

It has now surprisingly been found that cobalt powders having mainly an fcc-structure, can be used when manufacturing sintered bodies and that the use of such fcc-cobalt instead of cobalt mainly having an hcp-structure gives several advantages, both during the production of such sintered bodies as well for the sintered bodies. It has been particularly found that when using such fcc-cobalt powders, the sintered material contain less pores. It is also easier to avoid cracks formed by compaction of complex bodies, resulting in sintered hard metal compact bodies with complex geometries with less cracks and less distorted shape than for a corresponding material made from a hcp-cobalt powder.

It has also been found that, by using cobalt mainly having fcc-structure, a shorter milling time is required compared to when cobalt mainly having hcp-structure is used in order to achieve the same properties.

The method according to the present invention comprises the steps of mixing powders forming hard constituents with the powders forming a binder phase comprising cobalt and possible other compounds by milling. The milled mixture is dried and then pressed to form a body which then is sintered.

The amount of cobalt having mainly fcc-structure is characterized by XRD and the identification is given from the structural information taken from the public PDF-database (Powder Diffraction File by the International Centre for Diffration Data, ICDD) and represents the chemical compounds of interest i.e. fcc-cobalt (PDF 15-806) and hcp-cobalt (5-727). Additionally the Miller index of each metallic phase is given above each peak. At XRD measurements with a $2\theta/\theta$ focusing geometry and Cu-K$\alpha$ radiation with subsequent background subtraction and K$\alpha_2$-stripping, the peak height ratio between the Co-fcc(200)/ Co-hcp(101) being greater than or equal to about 3/2, preferably greater than or equal to about 7/4 and most preferably greater than or equal to about 2 as measured between the baseline and maximum peak height for each peak. The maximum amount of fcc-cobalt is 100% for which the above mentioned peak height ratio$\rightarrow\infty$. The cobalt powder described above which is used in the method according to the present invention will herein after be referred to as "fcc-cobalt".

The cobalt powder used in the method according to the present invention preferably comprises iron in an amount of less than about 1.5 wt %, preferably less than about 0.8 wt % and most preferably less than about 0.4 wt %. The cobalt powder further preferably contains at least about 100 ppm Mg, more preferably at least about 150 ppm Mg and most preferably from about 200 to about 500 ppm Mg.

The cobalt powder can also contain other elements but in amounts corresponding to technical impurities, preferably below about 800 ppm, more preferably below about 700 ppm and most preferably below about 600 ppm.

The grain size of the cobalt powder, measured as FSSS (Fischer grain size), is preferably from about 0.2 to about 2.9 μm, more preferably from about 0.3 to about 2.0 μm and most preferably from about 0.4 to about 1.5 μm.

The mean particle size (d50) of the cobalt powder, measured with laser diffraction, is preferably from about 0.8 to about 5.9 μm, more preferably from about 0.8 to about 4.0 μm and most preferably from about 0.8 to about 3.0 μm.

The powder forming hard constituents and the fcc-cobalt powder are milled in the presence of an organic liquid (for instance ethyl alcohol, acetone, etc) and an organic binder (for instance paraffin, polyethylene glycol, long chain fatty acids etc) in order to facilitate the subsequent granulation operation. Milling is performed preferably by the use of mills (rotating ball mills, vibrating mills, attritor mills etc).

Granulation of the milled mixture is preferably done according to known techniques, in particular spray-drying. The suspension containing the powdered materials mixed with the organic liquid and the organic binder is atomized through an appropriate nozzle in the drying tower where the small drops are instantaneously dried by a stream of hot gas, for instance in a stream of nitrogen. The formation of granules is necessary in particular for the automatic feeding of compacting tools used in the subsequent stage.

The compaction operation is preferably performed in a matrix with punches, in order to give the material the shape and dimensions as close as possible (considering the phenomenon of shrinkage) to the dimension wished for the final body. During compaction, it is important that the compaction pressure is within a suitable range, and that the local pressures within the body deviate as little as possible from the applied pressure. This is particularly of importance for complex geometries. It has now been found that this powder containing fcc-cobalt is especially suitable for compaction of compacts with geometries previously considered difficult.

Sintering of the compacted bodies takes place in an inert atmosphere or in vacuum at a temperature and during a time sufficient for obtaining dense bodies with a suitable structural homogeneity. The sintering can equally be carried out at high gas pressure (hot isostatic pressing), or the sintering can be complemented by a sintering treatment under moderate gas pressure (process generally known as SINTER-HIP). Such techniques are well known in the art.

The cobalt content in a sintered body greatly affects the properties of the sintered body. Depending on which properties that are important for the specific application the amount of cobalt also varies. The amount of fcc-cobalt used in the method according to the present invention is preferably in the range of from about 2 to about 30 wt %.

In the method according to the present invention, the hard constituents are preferably one or more of borides, carbides, nitrides or carbonitrides of tungsten, titanium, tantalum, niobium, chromium, and also other metals from groups IVa, Va and VIa of the periodical table. The grain size of the powders forming hard constituents depends on the application for the alloy and is preferably from about 0.2 to about 30 μm.

The invention has been described above with reference to the manufacture of a sintered body, with a binder phase of cobalt. It is evident that the invention also can be applied to the manufacture of articles of other composite materials with hard constituents as well as for materials where some of the cobalt has been replaced by other binder phase materials.

Also, other compounds commonly used in the making of sintered bodies can be added in the method according to the present invention, i.e., grain growth inhibitors, cubic carbides, etc.

In one embodiment of the present invention, the method relates to the production of a sintered body of cemented carbide. The amount of fcc-cobalt added varies significantly depending on the application. For example if the sintered body is a cutting tool insert, the fcc-cobalt is preferably added in an amount from about 2 to about 20 wt %, more preferably from about 4 to about 17 wt % and most preferably from about 5 to about 11 wt %. However, if the sintered body, for example, is a roll for hot rolling, the fcc-cobalt can be added in an amount of more than about 15 wt %, preferably more than about 20 wt %. For rock drilling tools, the cobalt content can vary between from about 6 to about 30 wt %, e.g., for percussive rock drilling, the amount of fcc-cobalt is preferably from about 5 to about 10 wt %, and for mineral tools from about 6 to about 13 wt %.

For wear parts the fcc-cobalt can be added in a wide range depending on the application but preferably from about 2 to about 30 wt %.

Grain growth inhibitors are also optionally added to cemented carbides, for example Cr and V, usually in an amount of from about 0.1 to about 3 and more preferably from about 0.1 to about 1 wt %. Cubic carbides of Ta, Ti and Nb can also be added, usually in an amount of from about 0.1 to about 10 wt % and the rest tungsten carbide.

In another embodiment of the present invention, the method relates to the production of a sintered body of titanium based carbonitride alloys, so called cermets. Cermets comprise carbonitride hard constituents embedded in a metallic binder phase. In addition to titanium, group VIa elements, normally both molybdenum and tungsten and sometimes chromium, are added to facilitate wetting between the binder and the hard constituents and to strengthen the binder by means of solution hardening. Group IVa and/or Va elements, i.e., Zr, Hf, V, Nb and Ta, are also added in all commercial alloys available today. All these additional elements are usually added as carbides, nitrides and/or carbonitrides. The grain size of the powders forming hard constituents is usually less than about 2 μm. The binder phase in cermets can comprise both fcc-cobalt and nickel but added as separate metal powders prior to sintering. The total amount of binder phase is preferably from about 3 to about 30 wt % and the relative proportions Co/(Co+Ni)*100 are preferably in the range from about 50 to 100 at %, more preferably from about 75 to 100 at % and most preferably from about 95 to 100 at %. The use of fcc-cobalt when making sintered bodies of cermets according to the present invention is specifically advantageous in cermets having only cobalt as binder phase. Especially in such grades the properties of the cobalt according to the present invention are of crucial importance. Other elements are sometimes added as well, e.g., aluminium, which are said to harden the binder phase and/or improve the wetting between hard constituents and binder phase.

The present invention also relates to a powder mixture comprising one or more powders forming hard constituents and powders forming binder phase which is ready to use for pressing and subsequent sintering to obtain sintered bodies. The powder mixture is milled and preferably granulated according to the techniques described above. The powders forming hard constituents are preferably one or more of borides, carbides, nitrides or carbonitrides of tungsten, titanium, tantalum, niobium, chromium, and also other metals from groups IVa, Va and VIa of the periodical table. The powder mixture comprises powders forming hard constituents in an amount of from about 70 to about 98 wt %. The powder mixture further contains powders forming a binder phase comprising cobalt which mainly has an fcc-structure, fcc-cobalt as defined above. The amount of fcc-cobalt in the powder mixture is determined with XRD as described above and is preferably from about 2 to about 30 wt %. The powder mixture may further comprise other compounds commonly used in powder mixtures used for making sintered bodies such as grain growth inhibitors, organic binders, etc.

In one embodiment, the present invention relates to a cemented carbide powder mixture comprising fcc-cobalt. The amount of fcc-cobalt varies significantly depending on the application. For example if the powder mixture will be used to make sintered bodies like cutting tool inserts the fcc-cobalt content preferably is from about 2 to about 20 wt %, more preferably from about 4 to about 17 wt % and most preferably from about 5 to about 11 wt %. However, if the powder mixture will be used to make sintered bodies like rolls for hot rolling, the fcc-cobalt content is more than about 15 wt %, preferably more than about 20 wt %. For powder mixtures used for rock drilling tools, the cobalt content can vary between from about 6 to about 30 wt %, e.g., for percussive rock drilling the amount of fcc-cobalt is preferably from about 5 to about 10 wt %, and for mineral tools from about 6 to about 13 wt %. If the powder mixture will be used to make sintered bodies like wear parts, the fcc-cobalt content can vary within a wide range depending on the application but preferably from about 2 to about 30 wt %.

The powder mixture can optionally also comprise grain growth inhibitors, for example Cr and V, in an amount of from about 0.1 to about 5 and, most preferably from about 0.1 to about 3 wt %. Cubic carbides of Ta, Ti and Nb can also be present in an amount of from about 0.1 to about 10 wt % and the rest tungsten carbide.

In another embodiment, the present invention relates to a powder mixture comprising titanium based carbonitride, so called cermets. In addition to titanium, group VIa elements, normally both molybdenum and tungsten and sometimes chromium, are present. Group IVa and/or Va elements, i.e. Zr, Hf, V, Nb and Ta, are also preferably present since they are all common additives in commercial alloys available today. All these additional elements are usually present as carbides, nitrides and/or carbonitrides. The powders forming the binder phase in the cermet powder mixture preferably comprises both fcc-cobalt and nickel. The total amount of binder phase in the cermet powder mixture is preferably from about 3 to about 30 wt % and the relative proportions Co/(Co+Ni)*100 are preferably in the range from about 50 to 100 at %, more preferably from about 75 to 100 at % and most preferably from about 95 to 100 at %.

The present invention also relates to a sintered body made according to the method disclosed herein. The sintered body comprises one or more hard constituents and a binder phase comprising cobalt which prior to compaction and sintering mainly has an fcc-structure characterized by XRD as described above. The cobalt content in the sintered body varies significantly depending on the application but is preferably from about 2 to about 30 wt %.

The sintered bodies according to the present invention can be used in many applications such as round tools, cutting tool inserts, wear parts, rollers, rock drilling tools, etc.

The invention is additionally illustrated in connection with the following examples, which are to be considered as illustrative of the present invention. It should be understood, however, that the invention is not limited to the specific details of the examples.

EXAMPLE 1

A: A cemented carbide tool insert was produced with the composition 6.0 wt % Co, 0.23 wt % TaC, 0.16% NbC and 93.6% WC, where the cobalt raw material being an ultrafine fcc-cobalt according to the present invention with a Co-fcc (200)/Co-hcp(101) ratio of 2.12 and FSSS of 1.08 μm. The raw materials were ball milled for 25 h with 0.5 l of an ethanol/water (90/10) mixture. The total weight of the solid materials was 1000 g. The suspension was spray dried and the granulated powder was pressed in a uniaxial press and sintered according to standard procedure.

B: A cemented carbide tool insert was produced with the same composition and the same production techniques under the same conditions as insert A, but where a commercial ultrafine cobalt with a Co-fcc(200)/Co-hcp(101) ratio of 0.08 and an FSSS of 0.7 μm was used instead of the fcc-cobalt according to the present invention.

The porosity of insert A and B was evaluated according to ISO standard 4505 (Hard Metals Metallografic determination of porosity and uncombined carbon). The results can be seen in table 1 below.

TABLE 1

| | Sintered density ($g/cm^3$) | Porosity ISO 4505 | Compaction pressure at 18% shrinkage, (MPa) |
|---|---|---|---|
| Sample A | 14.92 | A02; B02 | 107 |
| Sample B | 14.91 | A04; B04 | 125 |

EXAMPLE 2

A: A cermet powder was produced with the composition 18% WC, 12% NbC, 30% TiC, 26% TiN and 14% Co, using extrafine cobalt according to the invention with a Co-fcc (200)/Co-hcp(101) ratio of 2.24 and an FSSS of 1.45 μm. The raw materials (1000 g) were ballmilled with 0.51 of an ethanol/water (90/10) mixture for 25 h and spray dried.

B: An equivalent powder was produced with the same composition and the same production techniques under the same conditions as powder A, but where a commercial extrafine cobalt with a Co-fcc(200)/Co-hcp(101) ratio of 0.14 and an FSSS of 1.4 μm was used instead of the fcc-cobalt.

Inserts with the geometry R245-12T3E-L were pressed of powder A and B and sintered according to standard procedure. The results can be seen in table 2 below.

TABLE 2

| | Sintered density ($g/cm^3$) | Porosity ISO | Hardness HV3 | Compaction pressure at 18% shrinkage, (MPa) |
|---|---|---|---|---|
| Sample A | 6.56 | A06; B00 | 1600 | 110 |
| Sample B | 6.54 | A08; B00 | 1550 | 110 |

EXAMPLE 3

A: A cemented carbide powder was produced with the composition 6.0 wt % Co, 0.23 wt % TaC, 0.16% NbC and 93.6% WC, where the cobalt raw material being an ultrafine fcc-cobalt with a Co-fcc(200)/Co-hcp(101) ratio of 2.12 and an FSSS of 1.08 μm according to the present invention. The total weight of the powder materials was 28 kg. The powder materials were ball milled for 15 h and the suspension was spray dried.

B: An equivalent powder was produced with the same composition and the same production techniques under the same conditions as powder A, but where a commercial ultrafine cobalt with a Co-fcc(200)/Co-hcp(101) ratio of 0.08 and an FSSS of 0.7 μm was used instead of the fcc-cobalt.

Inserts with the geometry ZDGT200504R were pressed and then sintered according to standard procedure. The inserts made of powder B got horizontal cracks under cutting edge by pressing, while no cracks were observed on the inserts made of powder A. The results can be seen in table 3 below.

TABLE 3

| | Compaction pressure at 18% shrinkage, (MPa) | Cracks | Porosity ISO |
|---|---|---|---|
| Sample A | 168 | none | A02, B02 |
| Sample B | 199 | Cracks present close to cutting edge | A02, B02, some macropores |

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. Method of producing a sintered body comprising the steps of:

mixing one or more powders forming hard constituents with powders forming a binder phase comprising cobalt powder by milling, granulation of the milled mixture, compaction of the granulated mixture to form a compacted body, sintering the compacted body, wherein the cobalt powder comprises cobalt having mainly an fcc-structure defined as the peak height ratio between the Co-fcc(200)/Co-hcp(101) being greater than or equal to about 2, as measured between the baseline and maximum peak height, measured by XRD with a 2θ/θfocusing geometry and Cu-Kα radiation and where the cobalt powder has a grain size (FSSS) of from about 0.2 to about 1.5 μm.

2. Method of claim 1 wherein the amount of added cobalt powder is 2 to 30 wt %.

3. Method of claim 1 wherein at least one of the hard constituents is tungsten carbide.

4. A powder mixture ready to use in a compaction operation to form a compact which is subsequently sintered, comprising hard constituents and cobalt, the powder mixture comprising cobalt powder comprising cobalt having mainly an fcc-structure defined as the peak height ratio between the Co-fcc(200)/Co-hcp(101) being greater than or equal to about 2 as measured between the baseline and maximum peak height, measured by XRD with a 2θ/θfocusing geometry and Cu-Kαradiation and where the cobalt powder has a grain size (FSSS) of from about 0.2 to about 1.5 μm.

5. A powder mixture of claim 4 wherein the amount of cobalt in the powder mixture is from about 2 to about 30 wt %.

6. A powder mixture according to claim 4 wherein at least one of the hard constituents is tungsten carbide.

7. A sintered body made by the method of claim 1.

8. A sintered body made by the method of claim 2.

9. Method of claim 1 wherein the grain size (FSSS) is about 0.4 μm to about 1.5 μm.

10. Method of claim 1 wherein the cobalt powder has a mean particle size (d50) measured with laser diffraction of from about 0.8 to about 5.9 μm.

11. Method of claim 1 wherein the cobalt powder has a mean particle size (d50) measured with laser diffraction of from about 0.8 to about 4.0 μm.

12. Method of claim 1 wherein the cobalt powder has a mean particle size (d50) measured with laser diffraction of from about 0.8 to about 3.0 μm.

13. Method of claim 1 wherein a grain size of powders forming hard constituents is about 0.2 to about 30 μm.

14. Method of claim 1 wherein the cobalt powder includes at least about 100 ppm Mg.

15. Method of claim 1 wherein the cobalt powder includes at least about 150 ppm Mg.

16. Method of claim 1 wherein the cobalt powder includes at least about 200 ppm Mg.

17. A powder mixture according to claim 4 wherein the grain size (FSSS) is about 0.4 μm to about 1.5 μm.

18. A powder mixture according to claim 4 wherein the cobalt powder has a mean particle size (d50) measured with laser diffraction of from about 0.8 to about 5.9 μm.

19. A powder mixture according to claim 4 wherein the cobalt powder has a mean particle size (d50) measured with laser diffraction of from about 0.8 to about 4.0 μm.

20. A powder mixture according to claim 4 wherein the cobalt powder has a mean particle size (d50) measured with laser diffraction of from about 0.8 to about 3.0 μm.

21. A powder mixture according to claim 4 wherein a grain size of powders forming hard constituents is about 0.2 to about 30 μm.

22. A powder mixture according to claim 4 including at least about 100 ppm Mg.

23. A powder mixture according to claim 4 including at least about 150 ppm Mg.

24. A powder mixture according to claim 4 including at least about 200 ppm Mg.

* * * * *